US006220536B1

(12) United States Patent
Isaji et al.

(10) Patent No.: US 6,220,536 B1
(45) Date of Patent: Apr. 24, 2001

(54) MILLING MACHINE, METHOD OF CRUSHING ORE BY USE OF THE MILLING MACHINE, AND METHOD OF MANUFACTURING THE MILLING MACHINE

(75) Inventors: Kazutoshi Isaji, Nagoya; Tsukasa Mori; Yorizo Kudo, both of Chiba, all of (JP)

(73) Assignee: Shinwa Plant Kikou Co., Ltd., Nagoya (JP)

( * ) Notice: Subject to any disclaimer, the term of this patent is extended or adjusted under 35 U.S.C. 154(b) by 0 days.

(21) Appl. No.: 09/267,218

(22) Filed: Mar. 12, 1999

(30) Foreign Application Priority Data

Mar. 12, 1998 (JP) ..... 10-082801
Apr. 1, 1998 (JP) ..... 10-106955

(51) Int. Cl.[7] ..... B02C 17/00
(52) U.S. Cl. ..... 241/171; 241/179; 241/183
(58) Field of Search ..... 241/171, 179, 241/181, 182, 183

(56) References Cited

U.S. PATENT DOCUMENTS 2,029,917 * 2/1936 Frisch ..... 241/171
2,198,463 * 4/1940 Scott ..... 241/171
2,259,769 10/1941 Newhouse .
2,376,820 * 5/1945 Saumenicht ..... 241/171
2,670,139 2/1954 Treshow .
3,027,105 * 3/1962 Hall ..... 241/171

FOREIGN PATENT DOCUMENTS 2033365 1/1972 (DE) .
29515853 1/1996 (DE) .
446928 12/1912 (FR) .

OTHER PUBLICATIONS

Japanese Publication No. Sho–58 (1983)–124240, , Aug. 24, 1983.
Japanese Publication No. Sho–16 (1941)–4212, Apr. 5, 1941.
Japanese Patent Abstract 6320033A, Nov. 22, 1994.
Patent specification 342,130, Great Britain, 02/19/1931, Hardinge Co.
Patent specification 16,286, Great Britain, 02/11/1915, Harry Williams Hardinge.

* cited by examiner

*Primary Examiner*—John M. Husar
(74) *Attorney, Agent, or Firm*—Birch, Stewart, Kolasch & Birch, LLP

(57) ABSTRACT

There is described a milling machine which has a shell main unit and enables an improvement in the efficiency of crushing ore by uniform distribution of grinding members within the shell main unit and which enables an improvement in the quality of crushed stones by prevention of excessive crushing of ore. The shell main unit includes a first cylindrical section provided on an ore supply side and a second cylindrical section provided on a crushed stone outlet side. The first cylindrical section is tapered such that the inner diameter thereof becomes greater toward the ore supply side, and the second cylindrical section is tapered such that the inner diameter thereof becomes greater toward the ore supply side. The first cylindrical section is tapered with a very small cone angle, and the second cylindrical section is tapered with a cone angle greater than that of the first cylindrical section. The axial center of the shell main unit resides in the first cylindrical section.

13 Claims, 9 Drawing Sheets

MILLING MACHINE, METHOD OF CRUSHING ORE BY USE OF THE MILLING MACHINE, AND METHOD OF MANUFACTURING THE MILLING MACHINE

BACKGROUND OF THE INVENTION

1. Field of the Invention

The present invention relates to a milling machine which produces crushed stones by crushing an arbitrary ore through use of predetermined crushing members stored in a shell main unit, to a method of crushing an ore through use of the milling machine, and to a method of manufacturing the milling machine.

2. Description of the Related Art

In principle, a shell main unit of a conventional milling machine is formed into the shape of a hollow cylinder. A milling machine has a shell main unit of one of the below-described types intended for improving the efficiency of crushing ore by dropping and rotating grinding members provided in the shell main unit. For example, when the shell main unit is viewed from the side, an ore-feeder portion of the shell main unit is formed into the shape of a hollow cylinder, whereas an outlet portion of the shell main unit is formed into the shape of a hollow truncated cone tapered toward the direction of discharge. Another type of shell main unit has a reverse structure; namely, the ore-feeder portion of the shell main unit is formed into the shape of hollow truncated cone, whilst the outlet portion of the same is formed into the shape of a hollow cylinder. The grinding member is formed into the shape of a sphere or a deformed rectangular polyhedron.

The efficiency of crushing ore has been known to be improved by uniform and balanced distribution of grinding members within the shell main unit. The reason for this is that uniform distribution of grinding members results in crushing action uniformly acting on ore, thereby enabling excessive crushing of ore and energy loss. Since the amount of crushing energy to be dissipated is proportional to the size of a substance to be crushed, crushing action is uniformly exerted on ore by uniform distribution of crushing members, thereby improving the quality of crushed stones.

However, in the milling machine which has conventionally been utilized, the shape of the milling machine makes attainment of uniform distribution of crushing members within the shell main unit difficult. For this reason, the conventional milling machine experiences difficulty in greatly improving the efficiency of crushing ore and is apt to cause excessive crushing of ore.

SUMMARY OF THE INVENTION

Accordingly, the object of the present invention is to provide a milling machine which enables an improvement in an efficiency of crushing ore through uniform distribution of grinding members within a shell main unit and an improvement in the quality of crushed stones by prevention of excessive crushing of ore.

More specifically, according to a first aspect of the present invention, there is provided a milling machine for crushing ore into crushed stones comprising:

a hollow shell main unit which rotates about a rotation axis, wherein the shell main unit further includes a first hollow cylindrical section which is disposed on an ore supply side of the shell main unit and is tapered such that the inner diameter thereof becomes greater toward the ore supply side, and a second hollow cylindrical section which is disposed on the ore outlet-port side, is tapered such that the inner diameter thereof becomes greater toward the ore supply side, and has an internal space continuing from the first cylindrical section.

In this milling machine, the shell main unit assumes the foregoing shape, grinding members can be uniformly distributed within the entire shell main unit. Accordingly, the efficiency of crushing the ore can be improved to a much greater extent, thereby enabling a reduction in energy loss.

Preferably, the cone angle of the second cylindrical section is greater than the cone angle of the first cylindrical section. Since the first cylindrical section is tapered, the grinding members can be prevented from accumulating in a specific location of the first cylindrical section. Since the cone angle of the second cylindrical section is greater than that of the first cylindrical section, crushed stone and the grinding members are conveyed to the crushed-stone-outlet side through utilization of a difference in peripheral speed arising from rotation of the shell main unit, thereby enabling effective output of the ore to the outside. Accordingly, ore to be conveyed is prevented from accumulating in a connection section between the first cylindrical section and the second cylindrical section, thereby enabling uniform arrangement of the grinding members.

Preferably, the cone angle of the first cylindrical section is very small, and the cone angle of the second cylindrical section is significantly larger than that of the first cylindrical section. As a result, the ore and the milling members can be distributed more uniformly within the entire shell main unit. In other words, since the first cylindrical section assumes a very small cone angle, the grinding members can be uniformly distributed without accumulating in a specific location. Since the cone angle of the second cylindrical section is made so as to become significantly larger than that of the first cylindrical section, the crushed ore and the grinding members are conveyed to the outlet side through utilization of a difference in peripheral speed arising from rotation of the shell main unit, thereby effectively outputting the ore to the outside. Accordingly, the ore to be conveyed is prevented from accumulating in a connection section between the first cylindrical section and the second cylindrical section, thereby rendering the grinding members more uniform.

The large grinding members and the large pieces of ore concentrate in the first cylindrical section. In the second cylindrical section, the grinding members and the pieces of ore are uniformly arranged so as to become smaller in diameter toward the crushed-stone-outlet side. Therefore, the first cylindrical section provides the grinding members and the ore with the maximum drop and peripheral speed. Since the ore is crushed by the grinding members of large diameters, the ore is crushed with maximum physical impact. In the second cylindrical section, the grinding members and the pieces of ore become gradually smaller in drop and peripheral speed toward the crushed-stone-outlet side. The ore is crushed by the grinding members having smaller diameters, thereby preventing excessive crushing of the ore and resulting in an improvement in quality of crushed stones.

Preferably, the longitudinal center of the shell main unit resides in the first cylindrical section. As a result of the cylindrical section tapered with a very small cone angle being made longer than the cylindrical section tapered with a significantly large cone angle, the ore and the grinding members are prevented from accumulating in the vicinity of the exit of the shell main unit, which would otherwise be caused by an excessive increase in the efficiency of discharge.

Preferably, the ratio between the cone angle of the first cylindrical section and the cone angle of the second cylindrical section and the ratio between the axial length of the first cylindrical section and the axial length of the second cylindrical section are set such that the grinding members achieve a substantially uniform distribution within the shell main unit. Consequently, uniform distribution of the grinding members within the shell main unit enables improvement in the efficiency of crushing ore, as well as improvement in the quality of crushed stone.

Preferably, a liner is provided on the internal wall surface of the first and second cylindrical sections in the shell main unit. As a result, the efficiency of crushing ore can be improved in association with uniform distribution of the grinding members within the shell main unit.

Preferably, the milling machine further comprising: an ore storage section for storing ore which is to be fed; an ore conveying section for conveying the ore stored in the ore storage section to the shell main unit; at least a pair of outer ring members provided around the outer periphery of the shell main unit; and a drive apparatus for rotating the shell main unit.

In this milling machine, the ore fed from the ore storage section is supplied into the shell main unit by way of the ore conveying section, and the shell main unit is rotated by the drive apparatus by way of the outer ring members.

Preferably, a crushed-stone outlet port is provided on the end of the crushed stone outlet side portion of the second cylindrical section, and a partition plate is provided so as to become spaced away from the crushed-stone outlet port by a given gap. Consequently, uncrushed stone or the grinding members of large diameters can be prevented from outputting from the shell main unit.

According to a second aspect of the present invention, there is provided a method of crushing ore through use of a milling machine that comprises a hollow shell main unit made by continuously joining together a first cylindrical section—which is provided on an ore supply side and is tapered with a very small cone angle so as to have a larger inner diameter toward the ore supply side—and a second cylindrical section which is provided on a crushed stone outlet side and is tapered with a cone angle significantly greater than that of the first cylindrical section such that the inner diameter of the second cylindrical section becomes smaller toward the crushed stone outlet side, the method comprising the steps of:

feeding ore and grinding members into the shell main unit and rotating the shell main unit;

uniformly distributing the grinding members within the shell main unit through rotation of the shell main unit; and crushing the ore to crushed stone of predetermined size through rotation and drop of the grinding members.

Under the crushing method by use of the milling machine, the grinding members are actively and uniformly distributed by means of the shape of the first cylindrical section tapered with a very small cone angle and the shape of the second cylindrical section tapered with a significantly large cone angle, thereby enabling an improvement in the efficiency of crushing ore with the grinding members.

According to a third aspect of the present invention, there is provided a method of manufacturing a milling machine having a shell main unit, wherein the hollow shell main unit is manufactured by continuously joining together a first cylindrical section—which is provided on an ore supply side and is tapered with a very small cone angle so as to have a larger inner diameter toward the ore supply side—and a second cylindrical section—which is provided on a crushed stone outlet side and is tapered with a cone angle significantly greater than that of the first cylindrical section such that the inner diameter of the second cylindrical section becomes smaller toward the crushed stone outlet side—through setting of a ratio of cone angle between the first cylindrical section and the second cylindrical section and a ratio of axial length between the first cylindrical section and the second cylindrical section such that the grinding members are uniformly distributed within the shell main unit.

As a result, in a case where ore is crushed by use of the milling machine manufactured by the foregoing manufacturing method, the efficiency of crushing ore can be improved by uniform distribution of the grinding members within the shell main unit, thereby preventing excessive crushing of ore and enabling improvement in the quality of crushed stone.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DESCRIPTION OF THE PREFERRED EMBODIMENT

A preferred embodiment of the present invention will now be described by reference to the accompanying drawings.

Figure 1:
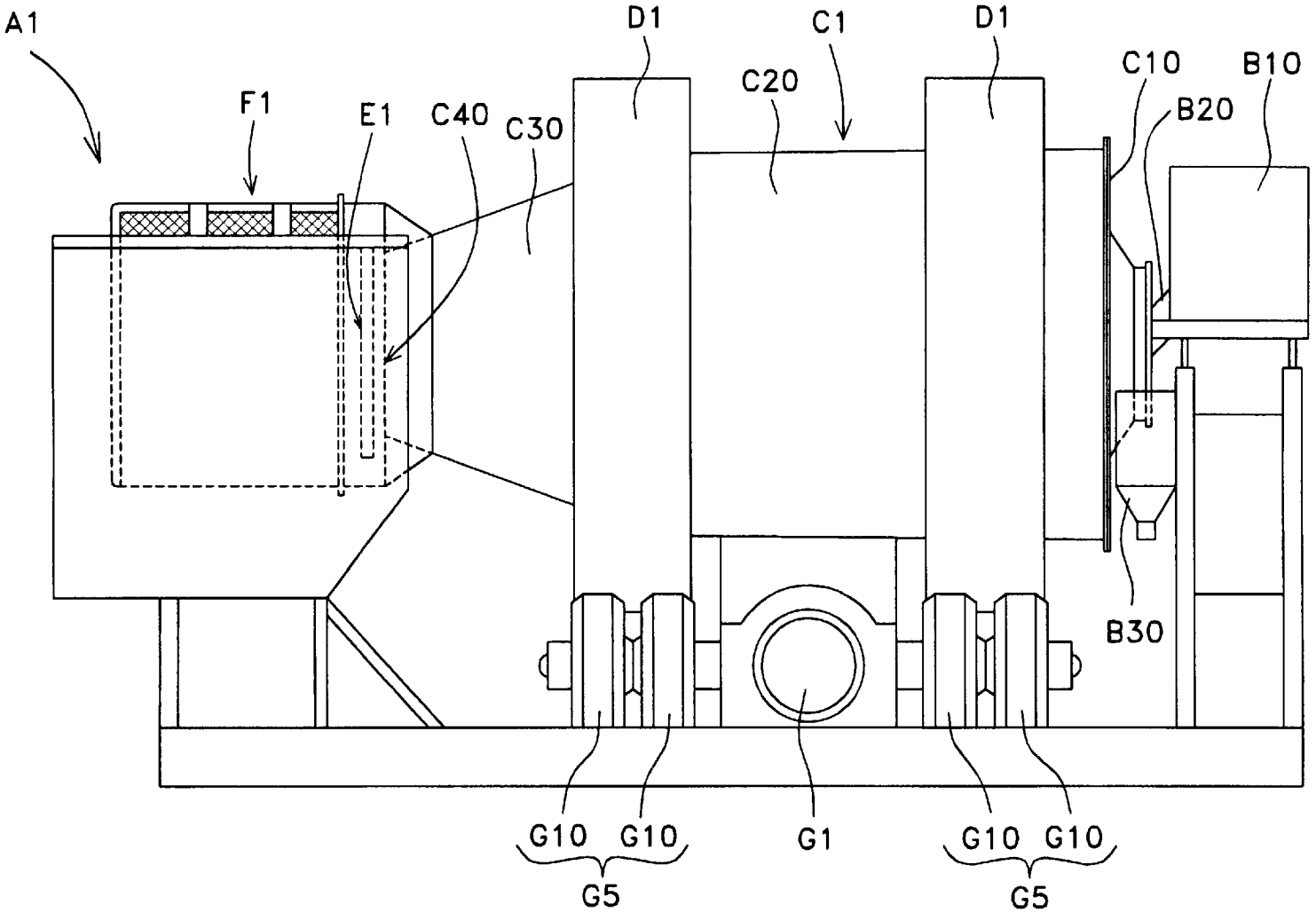
FIG. 1 is an external view showing a milling machine according to one embodiment of the present invention.

As shown in FIG. 1, a milling machine A1 according to a first embodiment comprises a hopper B10 serving as an ore storage section; a shell main unit C1; outer ring members D1; a partition plate E1; a classifier F1; and a drive unit G1.

Figure 2:
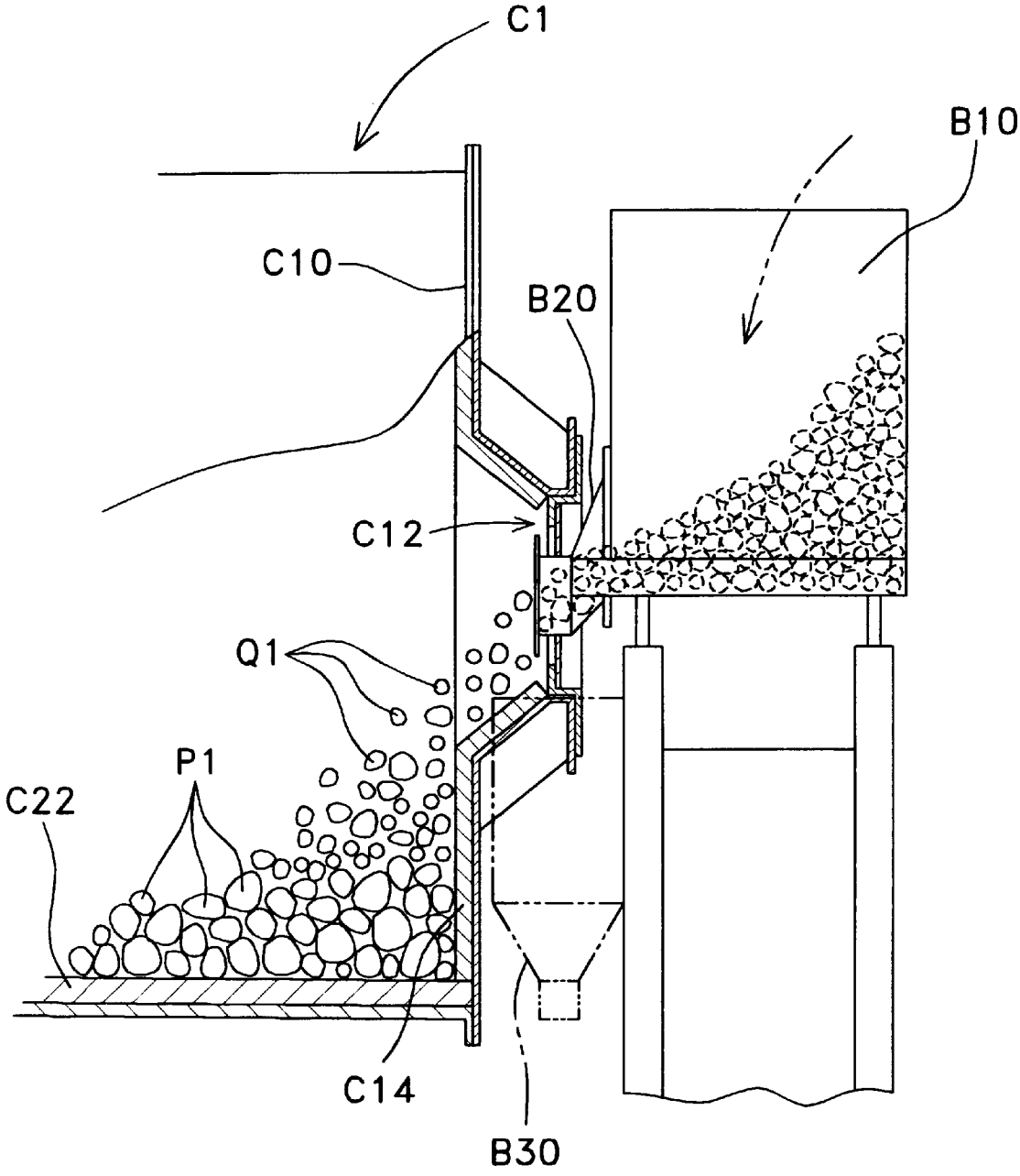
FIG. 2 is a view for illustrating the principle elements of an ore feeder portion.

As shown in FIG. 2, the hopper B10 assumes the shape of a vessel, and a chute B20 is formed at the lower end of the side surface of the hopper B10. The chute B20 has an outlet port for ore. When ore Q1 is fed into the hopper B10 from the outside, the ore Q1 is fed into an ore supply section C10 of the shell body C1, which will be described later, by way of the chute 20 in metered amounts. The chute B20 acts as an ore delivery section.

Figure 3:
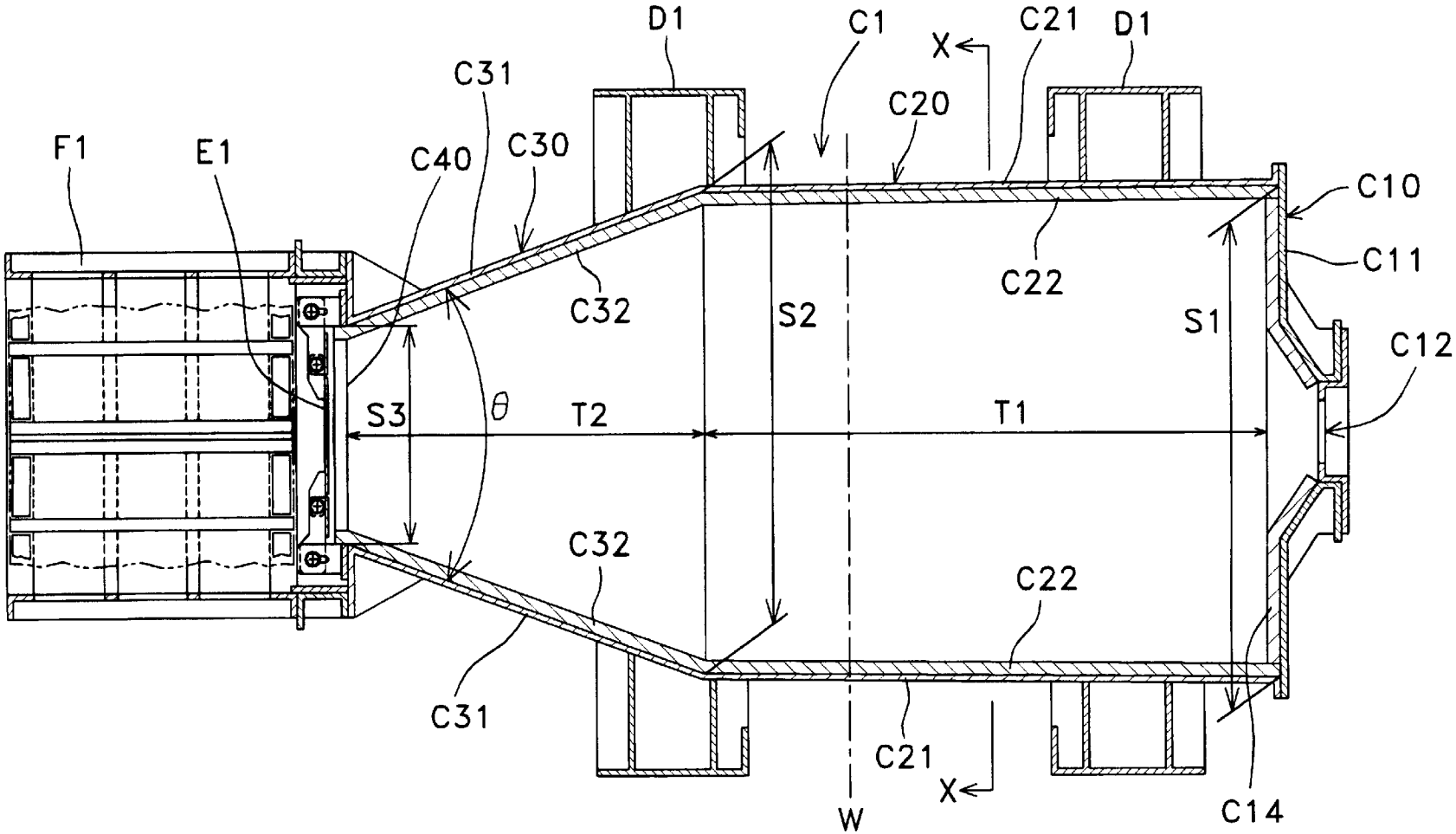
FIG. 3 is a cross-sectional view showing the structure of a shell main unit, outer ring members and a classifier.

As shown in FIG. 3, the shell main unit C1 comprises the ore supply section C10, a first cylindrical section C20, and a second cylindrical section C30.

The ore supply section C10 is substantially formed into the shape of a disk, and an ore inlet port C12 is formed in the center of the ore supply section C10 for the purpose of feeding of the ore Q1. The portion of the ore supply section C10 where the ore inlet port C12 is formed protrudes to the outside in a tapered manner. The ore supply section C10 serves as a side wall of an ore-supply side portion of the shell main unit C1. The chute B20 is fitted to the ore inlet port C12, and the ore Q1 is fed into the shell main unit C1.

Specifically, the ore supply section C10 has an outer wall section C11 and a liner C14, and the outer wall section C11 substantially assumes the shape of a disk. An opening where the ore inlet port C12 will be formed is formed in the center of the outer wall section C11, and the area of the ore supply section C10 where the opening is formed protrudes toward the outside in a tapered manner.

A collector section B30 is disposed below the ore feed portion C12 for the purpose of collecting overflowing ore or water.

The liner C14 is formed from metal or rubber over the internal wall surface of the shell main unit, i.e., the inner surface of the outer wall section C11. The liner C14 is uniformly formed so as to extend from the inner periphery of the outer wall section C11 up to the internal wall surface of the ore inlet port C12.

Figure 4:
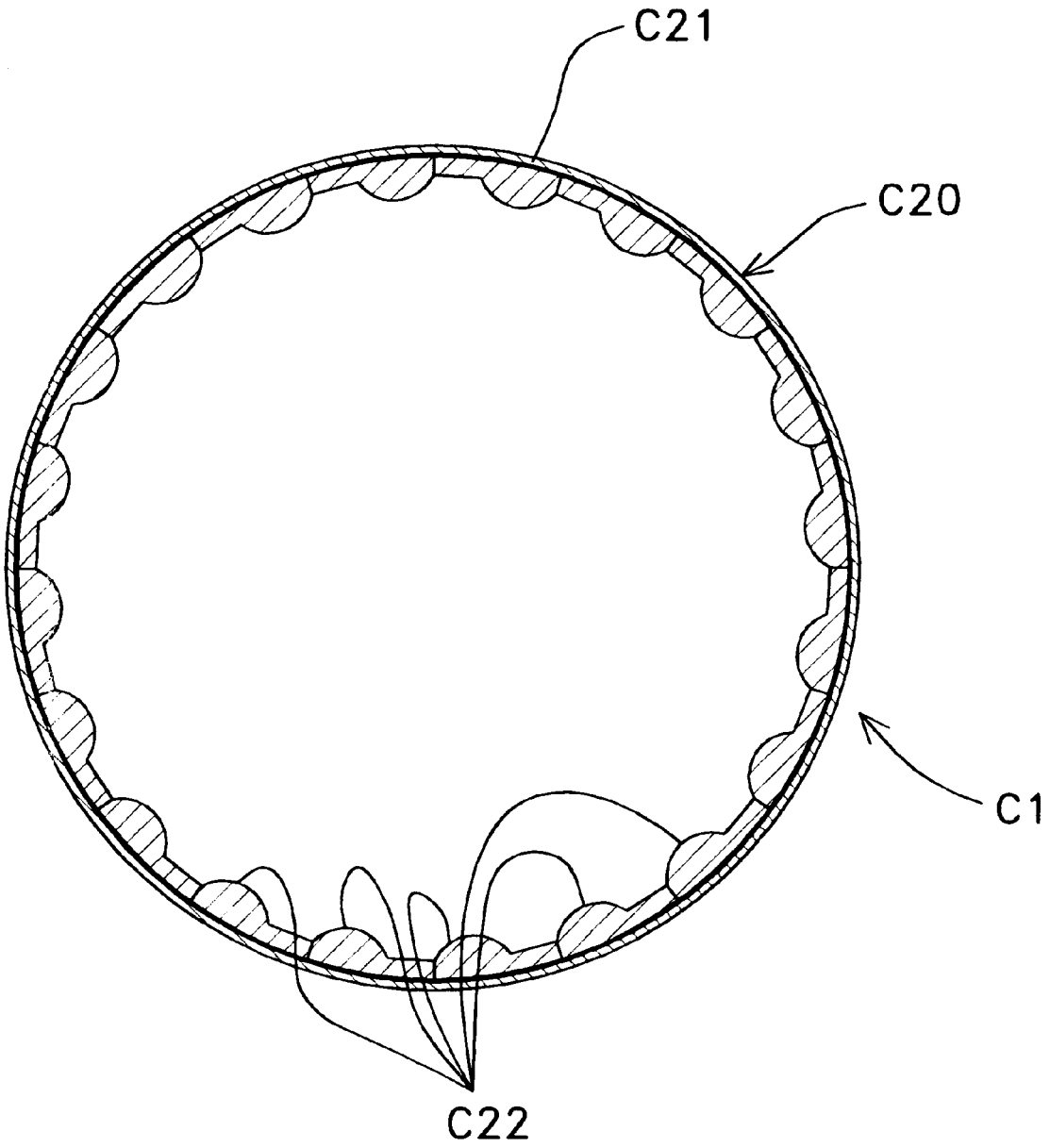
FIG. 4 is an end view showing the cross section of the shell main unit taken along line X—X shown in FIG. 3.

As shown in FIGS. 3 and 4, the first cylindrical section C20 substantially assumes a cylindrical shape and is positioned in the vicinity of the ore supply section in the longitudinal direction of the shell main unit C1. The first cylindrical section C20 is actually formed into the shape of a truncated cone which is tapered with a very small cone angle (not shown) such that the inner diameter of the first cylindrical section C20 becomes slightly greater toward the ore supply section. More specifically, the first cylindrical section C20 is formed such that an inner diameter S2 of the outlet-side portion thereof becomes smaller than an inner diameter S1 of the supply-side portion of the same. Here, the cone angle of the tapered first cylindrical section C20 corresponds to the angle which the outer surface of the first cylindrical section C20 forms with a plane surface passing through the rotation axis of the first cylindrical section C20.

In short, the first cylindrical section C20 comprises an outer wall section C21 and a liner C22, and the outer wall section C21 substantially assumes the shape of a cylinder and is formed into a truncated cone which is tapered by a very small cone angle such that the inner diameter thereof becomes greater toward the supply side portion of the outer wall section C21.

As shown in FIG. 4, the liner C14 is provided on an internal wall surface serving as the interior of the shell main unit, i.e., the inner surface of the outer wall section C21. More specifically, a plurality of substantially rectangular plane liners C22 formed from metal or rubber are uniformly laid on the internal surface of the first cylindrical section C20. As shown in FIG. 4, a one-half or more of each liner C22 is formed into a substantially oval-shaped protuberance, and the first cylindrical section C20 is formed so as to assume a longitudinal dimension T1, as shown in FIG. 3.

In a case where the first cylindrical section C20 assumes an internal diameter of about 2000 mm and cone angle $\alpha$ is defined as $\alpha=(S1-S2)/T1$, the first cylindrical section C20 assumes a very small cone angle of $0.01 \leqq \alpha \leqq 0.03$ or thereabouts, which through experimentation has been found to be preferable.

As shown in FIG. 3, the second cylindrical section C30 is substantially formed into the shape of truncated cone and is provided in the vicinity of a crushed stone outlet side of the shell main unit C1 in its longitudinal direction. The second cylindrical section C30 is formed in such a way as to assume a smaller internal diameter toward its outlet side and is sharply tapered with a cone angle greater than that of the first cylindrical section C20. In short, the second cylindrical section C30 is formed such that the inner diameter S3 of the outlet side thereof becomes sharply smaller than the inner diameter S2 of the supply-side portion of the same, as will be described later.

Specifically, the second cylindrical section C30 comprises an outer wall section C31 and a liner C32. The outer wall section C31 is formed such that the inner diameter thereof becomes smaller toward the outlet side and is formed into the shape of a truncated cone whose cone angle is greater than that of the first cylindrical section C20.

Figure 7:
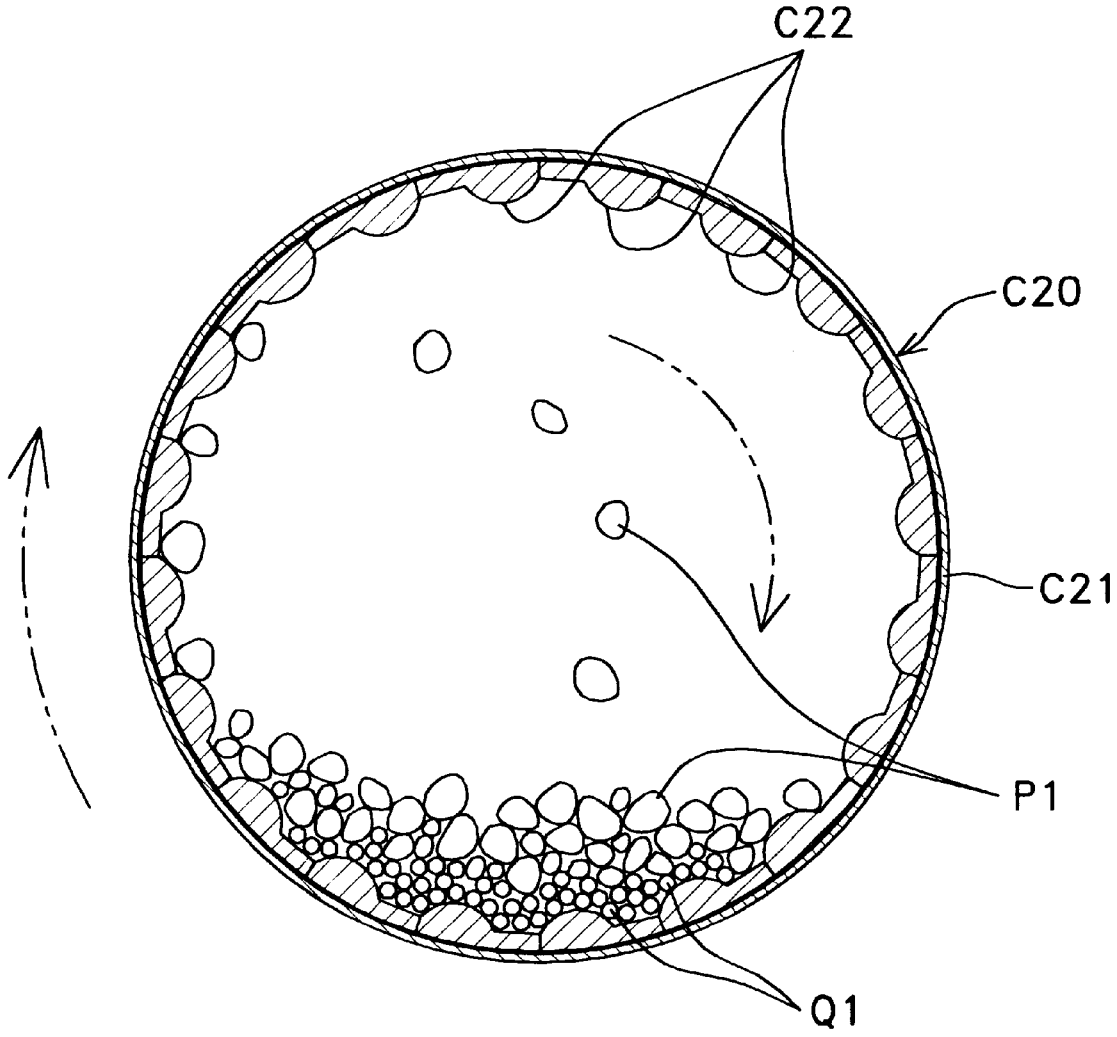
FIG. 7 is a view for illustrating a drop of grinding members during the operation of the milling machine.

Similar to the case of the first cylindrical section C20 as shown in FIG. 4, in the second cylindrical section C30 the liner C32 is provided on the internal wall surface serving as the interior of the shell main unit, i.e., the internal surface of the outer wall section C31. More specifically, a plurality of substantially rectangular plane liners C32 formed of metal or rubber are uniformly laid on the internal surface of the second cylindrical section C30. The liner C32 assumes the same cross section as that of the liner C22, as shown in FIG. 7, As shown in FIG. 3, the second cylindrical section C30 is formed so as to assume a longitudinal length of T2, and a crushed-stone outlet port C40 is formed in the crushed-stone-outlet-side portion of the second cylindrical section C30.

In a case where crushed stones assume a size of several millimeters or thereabout, the second cylindrical section C30 assumes a sharp cone angle $\theta$, shown in FIG. 3, of $30° \leqq \theta \leqq 50°$ or thereabouts, which through experimentation has been found to be preferable. The angle $\theta$ corresponds to the cone angle of the second cylindrical section C30. Here, the cone angle of the tapered second cylindrical section C30 corresponds to the angle which the outer surface of the second cylindrical section C30 forms with a plane surface passing through the rotation axis of the second cylindrical section C30.

The first cylindrical section C20 and the second cylindrical section C30 are connected together seamlessly, thereby constituting the hollow shell main unit C1. The axial length T1 of the first cylindrical section C20 is set as to be longer than the axial length T2 of the second cylindrical section C30.

Given that $\gamma=T2/(T1+T2)$, a preferred ratio between the length T1 and the length T2 is $0.32 \leqq \gamma \leqq 0.39$ or thereabouts, which through experimentation has been found to be preferable.

As shown in FIG. 3, the longitudinal center W of the shell main unit C1 resides in the first cylindrical section C20.

As shown in FIGS. 1 and 3, each of the pair of outer ring members D1 assumes the shape of a substantially circular strip and is provided along and integrally with the outer peripheral surface of the shell main unit C1; more particularly, one of the outer members D1 is provided in the vicinity of the ore supply section of the shell main unit C1 and the other is provided in the vicinity of the outlet side of the same. The pair of outer ring members D1 is provided on a group of tire sets G5, and each tire set G5 comprises two tires G10. Although FIG. 1 shows only two tires sets G5 provided on the front side of the milling machine A1, another group of tires GI is provided on the back side of the milling machine A1 behind the outer ring members D1. Since the outer ring members D1 remain in pressed contact with the group of tires G5, the outer ring members D1 are also rotated in conjunction with the tires G5 when the group of tires G5 is rotated by a drive unit G1.

Figure 5:
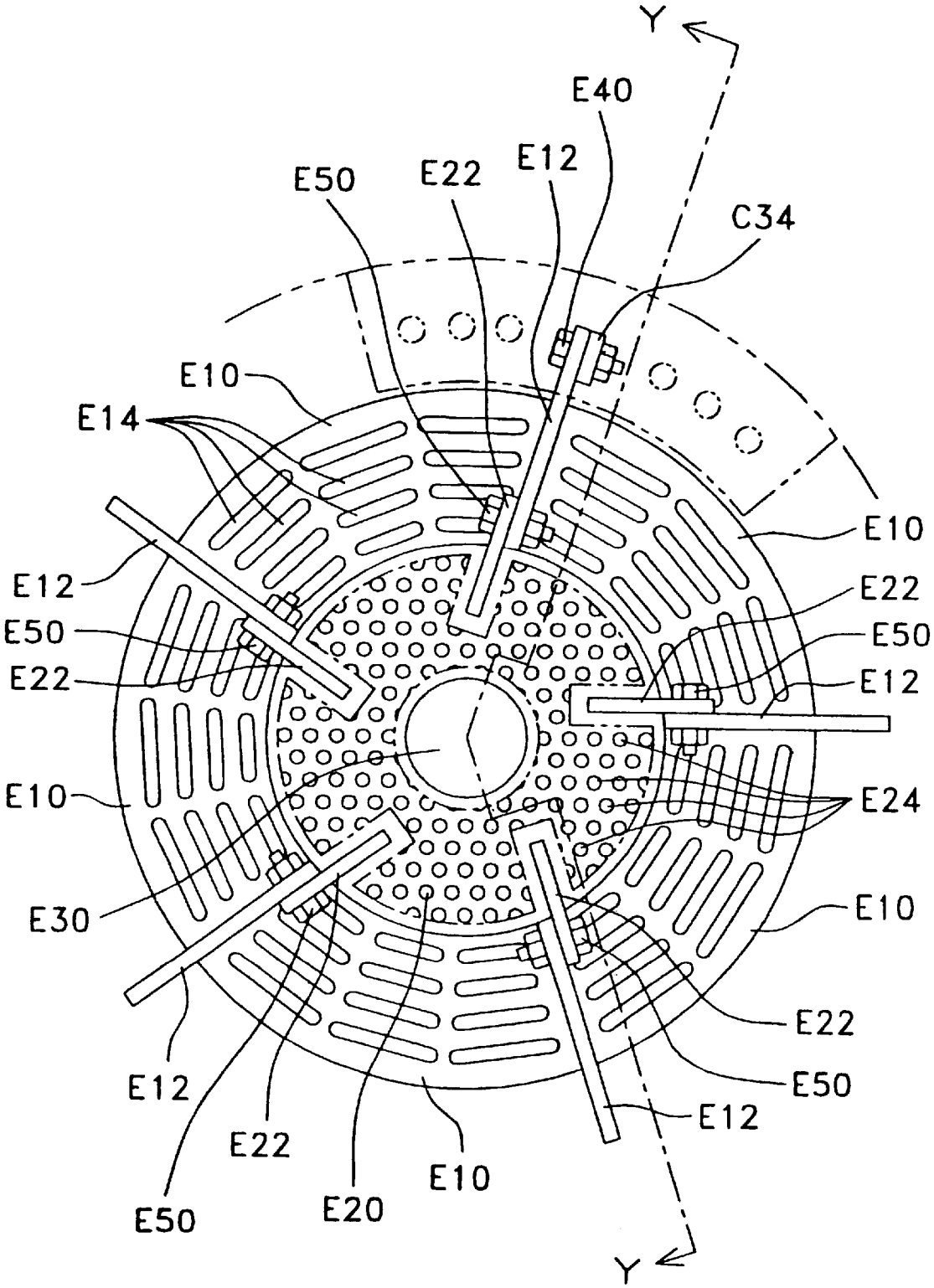
FIG. 5 is a side view showing the structure of a partition plate.
Figure 6:
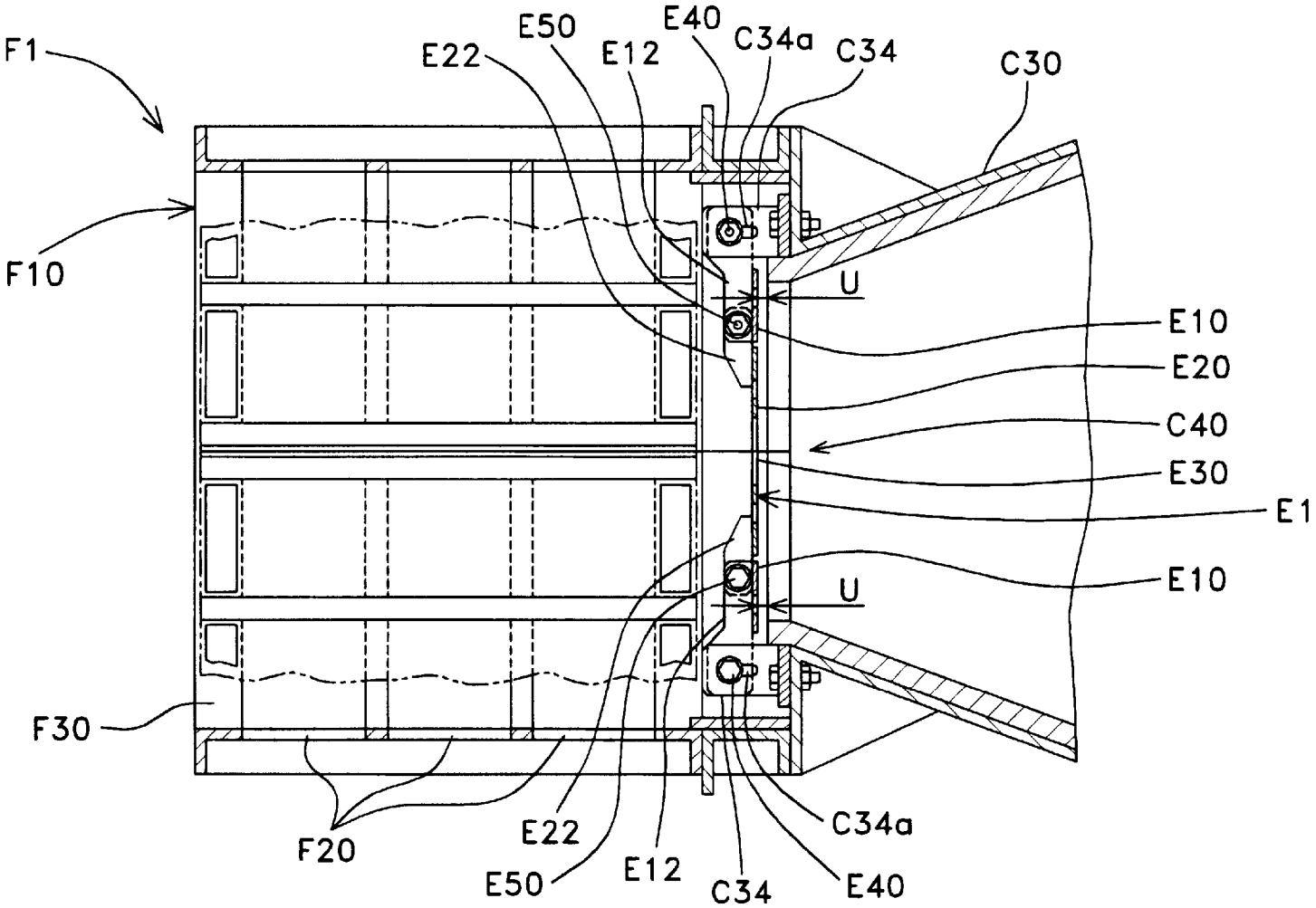
FIG. 6 is a cross-sectional view showing the principle elements of the partition plate and a classifier.

As shown in FIG. 5, the partition plate E1 is formed substantially into the shape of a disk and is disposed so as to become spaced from the crushed-stone outlet port C40 of the shell main unit C1 by only a gap U, as shown in FIG. 6. Here, the partition plate E1 in FIG. 6 is drawn in accordance with a cross-sectional view taken along line Y—Y shown in FIG. 5.

As shown in FIGS. 5 and 6, an outer diametrical portion of the partition plate E1 is formed by joining together five fan-shaped slit members E10 which are segmented with respect to the center of the partition plate E1. The five slit members E10 are fixed together through use of joint members E12 through welding. An inner diametrical portion of the partition plate E1 is formed from a single disk-shaped gravel-stop member E20, and joint members E22 are fixed to the gravel-stop member E20 by welding.

As shown in FIGS. 5 and 6, brackets C34 protruding from the edge of the second cylindrical section C30 are fastened to the joint members E12 by means of bolts E40, and the joint members E12 are fastened to the joint members E22 by means of bolts E50.

As shown in FIG. 6, each of the brackets C34 is fastened to the corresponding joint member E12 by way of an elongated hole C34*a* formed in the bracket C34. Therefore, the position of the partition plate E1 can be adjusted in the axial direction of the shell main unit C1. As shown in FIG. 6, the elongated hole C34*a* is formed so as to be longer in the axial direction of the shell main unit C1. As a result, the gap U between the crushed-stone out let port C40 can be changed in accordance with the volume of ore Q1 to be fed into the milling machine A1 as well as with the size of crushed stones R1 to be outputted.

As shown in FIG. 5, a plurality of grinding member stop slits E14 are formed in each of the slit members E10, and a plurality of gravel-stop holes E24 are formed in the gravel-stop member E20. Furthermore, an opening E30 of substantially circular shape is formed in the gravel-stop member E20. Preferably, the grinding member stop slits E14 and the gravel-stop holes E24 are formed so as to become tapered such that the holes and slits have a greater diameter at their outlet-side portions than at their diameter in their shell-main-unit-side portions. Even if crushed stones or debris enter the grinding member stop slits E14 or the gravel-stop holes E24, they will be readily released.

As shown in FIG. 6, the classifier F1 is substantially formed into the overall shape of a cylinder, and the outer periphery of the classifier F1 is formed into a cylindrical member F10. The cylindrical member F10 is fastened to the shell main unit C1 by means of bolts and rotates simultaneous with rotation of the shell main unit C1. A screen member F20 is provided along the outer periphery of the cylindrical member F10 while being divided in three segments in the axial direction thereof and permits selective passage of only crushed stone of a certain particle size. As shown in FIG. 6, an opening not having a screen is formed in a forward end section F30 of the cylindrical body F10. The opening allows discharge of crushed stones which is of greater than a certain particle size and cannot pass through the screen member F20. The classifier F1 has a capability of classifying crushed stone which is of certain particle size and can pass through the screen member F20 and crushed stone which is of greater than a certain particle size and cannot pass through the screen member F20.

The drive unit G1 comprises a motor and gears and is arranged so as to transmit torque to the group of tires G5.

The operation and advantageous results of the present invention will now be described.

As shown in FIG. 2, grinding members P1—which comprise a mixture of different sized grinding members and are each formed into the shape of a sphere—are housed in the shell main unit C1. The ore Q1 fed from the hopper B10 is supplied in metered amounts into the shell main unit C1 along a slope of the chute B20 by way of the ore inlet port C12. In a case where the ore is fed with water, a predetermined amount of water is also supplied to the shell main unit C1 together with the ore Q1.

By force of gravity, the ore Q1 is supplied from the hopper B10 and the chute B20 to the shell main unit C1. Therefore, the milling machine A1 does not require an ore supply apparatus which forcefully supplies ore into the shell main unit C1 by means of a commonly-employed drive unit.

As shown in FIG. 3, since the crushed stone outlet port C40 is sufficiently larger in diameter than the ore inlet port C12, the ore Q1 is smoothly conveyed and discharged and does not accumulate in the vicinity of the ore supply section C10. Therefore, there is no need to squeeze the ore Q1 into the ore supply section C10. Since the milling machine A1 does not need the foregoing forceful ore supply apparatus, the milling machine A1 can accordingly be formed into a simple and inexpensive structure. Alternatively, the milling machine may be formed by use of a forceful ore supply apparatus such as that mentioned previously. In this case, even when a large volume of ore is fed into the milling machine A1, the ore can be smoothly fed and discharged.

As shown in FIG. 7, when the shell main unit C1 is rotated by the drive unit G1 by way of the tires G10 and the outer ring members D1, the grinding members P1 are raised by action of the plurality of liners C22. When the liner C22 is raised to such an angle in relation to the horizontal plane thereof so as to be unable to hold the grinding members P1, the grinding members P1 are dropped as shown in the drawing. As a result, the ore Q1 positioned directly below the grinding member P1 is crushed by means of the grinding members P1.

Figure 8:
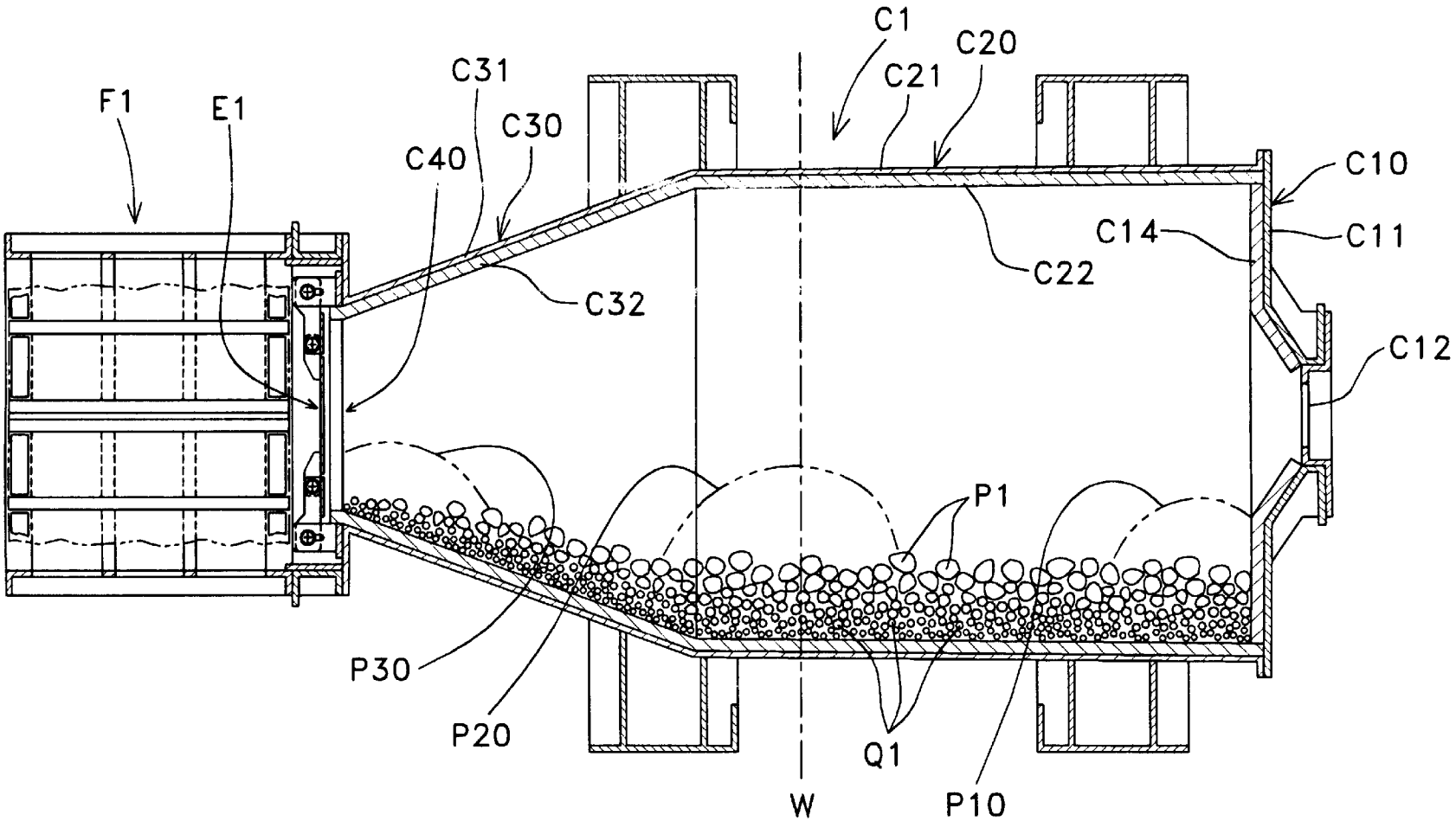
FIG. 8 is a view for illustrating the distribution of the grinding members during the operation of the milling machine.

As mentioned previously, the first cylindrical section C20 is tapered with a very small cone angle, and the second cylindrical section C30 is tapered with a cone angle greater than that of the first cylindrical section C20. Further, the axial center of the shell main unit C1 resides in the first cylindrical section C20. As shown in FIG. 8, the grinding members P1 are distributed uniformly (in a horizontal direction) within the shell main unit C1. The reason for this is will now be described.

The movement of the grinding members P1 is pursuant to the basic principle of a milling machine; namely, larger grinding members move toward an opening having a large diameter, and smaller grinding members move toward an opening having a small diameter. As mentioned above, the first cylindrical section C20 is tapered with a very small cone angle such that the inner diameter of the first cylindrical section C20 becomes greater toward the ore supply section. Therefore, the grinding members P1 do not move toward any direction because of variations in the diameter of the grinding members P1. If the first cylindrical section C20 is tapered with a large cone angle, the grinding members P1 having large diameters concentrate in an area designated by P10 shown in FIG. 8 (i.e., the side of the shell main unit Q1 into which the ore Q1 is fed), whereas the grinding members P1 having smaller diameters concentrate in an area designated by P20 shown in FIG. 8 (i.e., the center of the shell main unit C1). Such concentration of grinding members in any location does not occur in the present embodiment.

Conversely, if the first cylindrical section C20 is not tapered at all, there is a reduction in the effect of discharging the ore Q1 toward the outlet side by means of a difference in circumferential speed. As a result, the ore Q1 accumulates in the position designated by P10 shown in FIG. 8.

Accordingly, the first cylindrical section C20 is set so as to be tapered with a very small cone angle, thereby enabling uniform distribution of the grinding members P1. For this reason, the efficiency of crushing the ore Q1 through rotation and drop of the grinding members P1 can be improved.

The very small cone angle of the first cylindrical section C20 is determined according to the material, size, shape, and volume of the grinding members P1 fed into the milling machine A1, as required.

The second cylindrical section C30 is tapered toward the outlet side with a cone angle larger than that of the first cylindrical section C20. With this configuration, the tapered section having a large cone angle causes a great difference in circumferential speed, and therefore the ore Q1 conveyed from the first cylindrical section C20 can be sufficiently discharged to the crushed-stone outlet port C40. Therefore, the ore Q1 and the grinding members P1 are prevented from accumulating in the area designated by P20 shown in FIG. 8, which would otherwise be caused by insufficient conveyance. As a result of the second cylindrical section C30 being tapered with a cone angle greater than that of the first cylindrical section C20, the distribution of the grinding members P1 can be made uniform, thereby enabling an improvement in the efficiency of crushing the ore Q1 through rotation and drop of the grinding members P1.

The cone angle of the second cylindrical section C30 is determined according to the material, size, shape, and volume of the grinding members P1 fed into the milling machine A1, as required.

The axial center W of the shell main unit C1 resides in the first cylindrical section C20, and the first cylindrical section C20 is longer than the second cylindrical section C30. Accordingly, the portion of the first cylindrical section C20 tapered with a very small cone angle is longer than the portion of the second cylindrical section C30 tapered with a large cone angle. For this reason, neither the ore Q1 nor the grinding members P1 accumulate in the vicinity of the crushed-stone outlet port C40. In other words, the ore Q1 and the grinding members P1 are prevented from accumulating in an area designated by P30 shown in FIG. 8 (i.e., in the vicinity of the crushed-stone outlet port C40), which would otherwise be caused by an excessive increase in the efficiency of discharge.

As mentioned above, by means of the ratio (or balance) among the very small cone angle of the first cylindrical section C20, the large cone angle of the second cylindrical section C30, the length of the first cylindrical section C20, and the length of the second cylindrical section C30, the grinding members P1 can be uniformly distributed within the shell main unit C1. As a result, the efficiency of crushing the ore Q1 through rotation and drop of the grinding members P1 can be improved, thereby enabling a reduction in energy loss.

The grinding members P1 and the pieces of ore Q1 having the largest diameters concentrate in the first cylindrical section C20. Further, in the tapered portion of the second cylindrical section C30, the grinding members P1 and the pieces of ore Q1 are uniformly arranged so as to become smaller in diameter toward the crushed-stone outlet port C40. Therefore, the first cylindrical section C20 provides the grinding members P1 and the ore Q1 with the maximum drop and peripheral speed. Since the ore Q1 is crushed by the grinding members P1 of large diameters, the ore Q1 is crushed with maximum physical impact. In the second cylindrical section C30, the grinding members P1 and the pieces of ore Q1 become gradually smaller in drop and peripheral speed toward the crushed-stone outlet port C40. The ore Q1 is crushed by the grinding members P1 having smaller diameters, thereby preventing excessive crushing of the ore and resulting in an improvement in quality of crushed stones.

The ore Q1 is efficiently crushed into crushed stones R1 of predetermined size by the uniformly-distributed grinding members P1. The thus-crushed stone R1 is discharged to the classifier F1 in direction of arrow Ua shown in FIG. 9 from the gap U between the crushed-stone outlet port C40 and the partition plate E1.

Figure 9:
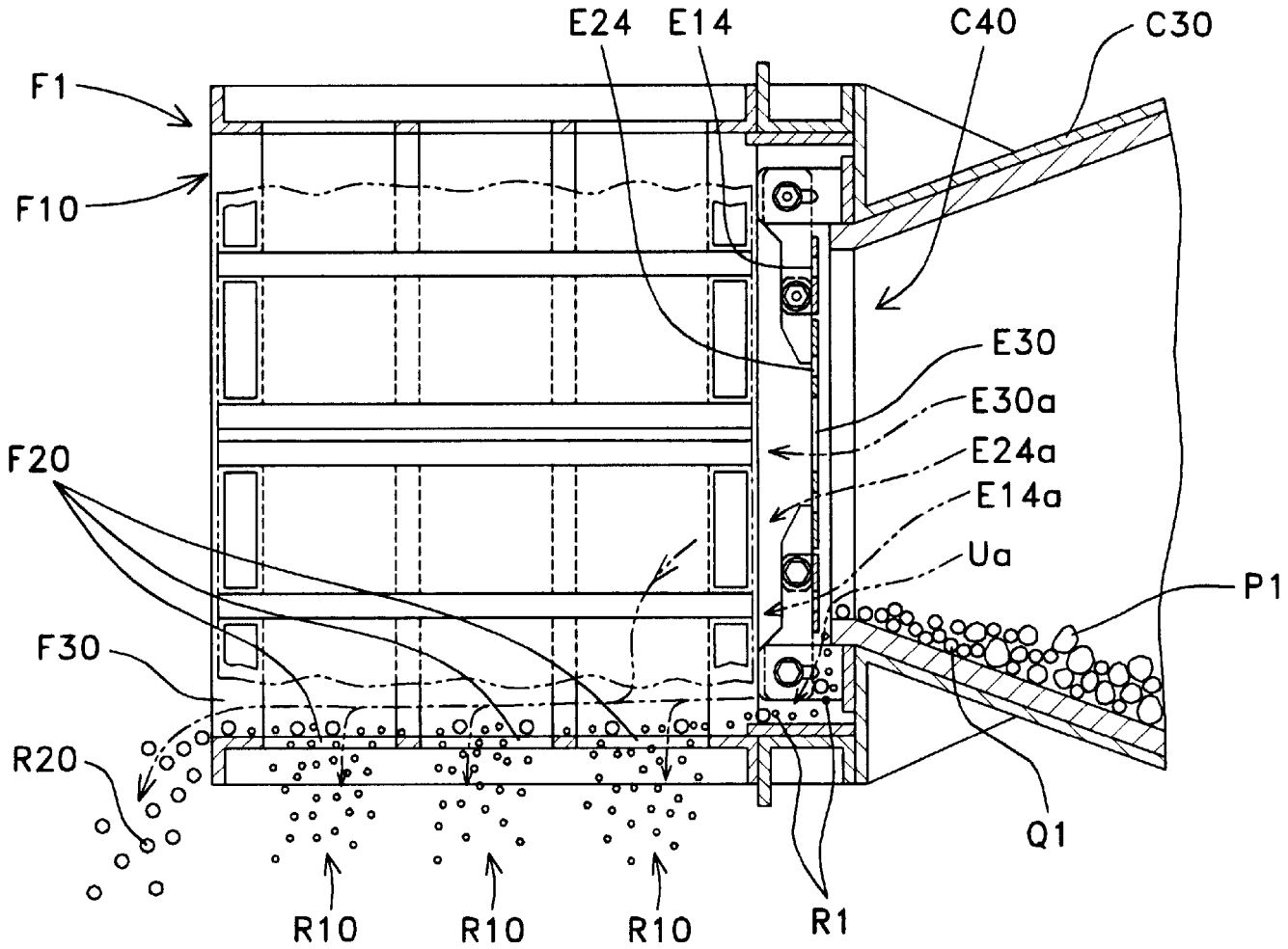
FIG. 9 is a view for illustrating the operation of the classifier.

In a case where a large volume of ore Q1 is fed into the milling machine A1 and where the crushed stone R1 is discharged in large amounts, the crushed stone R1 is discharged to the classifier F1, as designated by arrow E14*a* shown in FIG. 9, even from the grinding member stop slits E14 formed in each of the slit member E10. If the size of the grinding member stop slits E14 is set to a predetermined value or smaller, the grinding members P1 are prevented from being discharged from the grinding member stop slits E14 and are retained.

When the volume of ore Q1 fed into the milling machine A1 becomes greater than the foregoing volume, the crushed stone is discharged to the classifier F1, as designated by arrow E24*a* shown in FIG. 9, even from the gravel-stop holes 24 formed in the gravel-stop member 20. If the size of the gravel-stop member E24 is set to or smaller than a predetermined value, the uncrushed pieces of ore Q1 and the grinding members P1 are prevented from being discharged from the gravel-stop holes E24 and are retained.

The opening E30 formed in the inner diametrical portion of the gravel-stop hole E24 is used as a drain, as indicated by arrow of E30*a* shown in FIG. 9, in the event of the gap U, the grinding member stop slits E14, or the gravel-stop holes E24 becoming clogged or in the event of an excessive amount of water being fed into the milling machine A1. Further, the opening E30 is also used as an observation window for observing the shell main unit C1 from the outside. In normal operations, the opening E30 is not used for discharging the crushed stones R1.

The gap U is in principle formed so as to be greater than the width of the grinding member stop slit E14 or the width of the gravel-stop slit E20. Consequently, the pieces of crushed stone R1 larger than the gap U are prevented from being discharged from the shell main unit C1.

The classifier F1 classifies the crushed stones R1 conveyed from the second cylindrical section c30 into crushed stone R10 which can pass through the screen member f20 and crushed stone R20 which is greater in particle size than the crushed stone R10.

In the previously-described milling machine A1 according to the present embodiment, the first cylindrical section C20 is tapered with a very small cone angle, and the second cylindrical section C30 is tapered with a cone angle far greater than that of the first cylindrical section C20. With this structure, the very small cone angle of the first cylindrical section C20 enables uniform distribution of the grinding members P1 and the ore Q1 without involvement of accumulation of the grinding members P1 and the ore Q1. Further, since the second cylindrical section C30 is tapered with a great cone angle, the ore Q1 crushed in the shell main unit C1 and the grinding members P1 are conveyed to the outlet-port side in the shell main unit C1 by utilization of a difference in peripheral speed arising from rotation of the shell main unit C1, thereby effectively discharging the ore Q1 to the outside. More specifically, the ore Q1 that is conveyed from the first cylindrical section C20 to the second cylindrical section C30 is prevented from accumulating in a connection path between the first cylindrical section C20 and the second cylindrical section C30, thereby rendering the grinding members P1 more uniform. As a result, the efficiency of crushing the ore Q1 through rotation and drop of the grinding members P1 can be improved, and therefore energy loss can be diminished.

The grinding members P1 and the pieces of ore Q1 having the largest diameter concentrate in the first cylindrical section C20. Further, in the tapered portion of the second cylindrical section C30, the grinding members P1 and the pieces of ore Q1 are uniformly arranged so as to become smaller in diameter toward the crushed-stone outlet port C40. Therefore, the first cylindrical section C20 provides the grinding members P1 and the ore Q1 with maximum drop and peripheral speed. Since the ore Q1 is crushed by the grinding members P1 having large diameters, the pieces of ore Q1 are crushed with the maximum physical impact. In the second cylindrical section C30, the grinding members P1 and the ore Q1 become gradually smaller in drop and peripheral speed toward the crushed-stone outlet port C40. The ore Q1 is crushed by the grinding members P1 having smaller diameters, thereby preventing excessive crushing of the ore and resulting in an improvement in quality of crushed stones.

In manufacturing the milling machine A1, the milling machine A1 is set so as to attain an optimum ratio between the cone angle of the first cylindrical section C20 and the second cylindrical section C30 and an optimum ratio between the length of the first cylindrical section C20 and the length of the second cylindrical section C30, in order to uniformly distribute the grinding members P1 within the shell main unit C1. Therefore, uniform distribution of the grinding members P1 can be realized more actively, and the efficiency of crushing the ore Q1 by means of the grinding members P1 can be improved.

As mentioned previously, the very small cone angle of the first cylindrical section C20 and the large cone angle of the second cylindrical section C30 depend on various elements such as (1) the inner diameter of the first cylindrical section C20 and that of the second cylindrical section C30; (2) a length ratio between the first cylindrical section C20 and the second cylindrical section C30; (3) the material, size, shape, and volume of the grinding members P1 to be used; (4) the material, size, shape, and volume of ore to be crushed; (5) the performance of the liner to be used; and (6) the rotation speed of the shell main unit C1. Therefore, the cone angles of the cylindrical sections C20 and C30 cannot be calculated directly.

For these reasons, according to (1) the preset inner diameters of the first and second cylindrical sections C20 and C30; (2) the material, size, shape, and volume of the grinding members P1 to be used; (3) the material, size, shape, and volume of ore to be crushed; (4) the performance of the liner to be used; and (5) the rotation speed of the shell main unit C1, the ratio of cone angle between the first cylindrical section C20 and the second cylindrical section C30 is set such that the grinding members P1 are uniformly distributed within the shell main unit C1, in the manner as mentioned previously. Further, the length ratio between the first cylindrical section C20 and the second cylindrical section C30 is set such that the grinding members P1 are uniformly distributed within the shell main unit C1. Thus, the cone angles and the lengths of the first and second cylindrical sections C20 and C30 are selected through balancing (or tuning), as required.

Although each of the grinding members P1 assumes the shape of a sphere in the foregoing description, the present invention is not limited solely to that shape. A grinding member of arbitrary shape, size, and material, such as a deformed rectangular polyhedron or a regular polyhedron, may also be used as the grinding member, as required, according to the volume, shape, material, and size of ore to be crushed and according to a desired shape, size, and volume of crushed stone. Metal, ceramics, or rubber may preferably be used as the material of the grinding member P1. However, the material is not limited solely to these materials, and arbitrary selection and use of another material may also be feasible.

The expression "uniform distribution of grinding members" used herein does not signify completely uniform distribution of grinding members but uniform spreading of grinding members without tending to move toward any place, which would otherwise adversely affect the efficiency of crushing ore. Accordingly, even in the present embodiment, it is assumed that grinding members slowly accumulate in the vicinity of a connection section between the first cylindrical section C20 and the second cylindrical section C30, thereby resulting in a slight increase in the thickness of a layer of grinding members. The tendency of the grinding members to move toward any position, which would not affect the efficiency of crushing ore, falls within the scope of the present invention.

The term "uniform" used in the description "The grinding members P1 and the pieces of ore Q1 having the largest diameter concentrate in the first cylindrical section C20. Further, in the tapered portion of the second cylindrical section C30, the grinding members P1 and the pieces of ore Q1 are arranged so as to become smaller in diameter toward the crushed-stone outlet port C40," signifies that the large pieces of ore Q1 are crushed by the large grinding members P1, and the small pieces of ore Q1 are crushed by the small grinding members P1. In short, the grinding members and the pieces of ore are uniformly arranged in decreasing order of magnitude, thus preventing a state of irregular imbalance, such as the small pieces of ore Q1 being crushed by the large grinding members P1 and the large pieces of ore Q1 being crushed by the small grinding members P1.

The shape, size, material, and operating method of individual components according to the present invention may be arbitrarily determined within the extent to which the foregoing object, the foregoing operation, and advantageous result to be described later of the present invention are accomplished. As a matter of course, modifications of these elements shall fall within the scope of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principle of the invention and its practical application to thereby enable one of ordinary skill in the art to utilize the invention in various embodiments and with various modifications as are suited to the particular use contemplated. All such modifications and variations are within the scope of the invention as determined by the appended Claims when interpreted in accordance with the breadth to which they are fairly, legally, and equitably entitled.

What is claimed is:

1. A milling machine for crushing ore into crushed stones comprising:

a hollow shell main unit which rotates about a rotation axis, wherein the shell main unit further includes a first hollow cylindrical section which is disposed on an ore supply side of the shell main unit and is tapered such that the inner diameter thereof becomes greater toward the ore supply side, and a second hollow cylindrical section is disposed on an ore outlet-port side and is tapered such that the inner diameter thereof becomes greater toward the ore supply side, and has an internal space continuing from the first cylindrical section;

an ore storage section for storing ore which is to be fed into said milling machine;

an ore conveying section for conveying the ore stored in the ore storage section to the shell main unit;

at least a pair of outer ring members provided around the outer periphery of the shell main unit;

a drive apparatus for rotating the shell main unit by way of the outer ring members; and a crushed-stone outlet port is provided on the end of the crushed stone outlet side portion of the second cylindrical section, and a partition plate is provided so as to become spaced away from the crushed-stone outlet port by a gap, wherein a substantially circular opening is formed in a center of the partition plate.

2. The milling machine as defined in claim 1, wherein the cone angle of the second cylindrical section is greater than the cone angle of the first cylindrical section.

3. The milling machine as defined in claim 2, wherein the axial center of the shell main unit resides in the first cylindrical section.

4. The milling machine as defined in claim 1, wherein the cone angle of the first cylindrical section is very small, and the cone angle of the second cylindrical section is significantly larger than that of the first cylindrical section.

5. The milling machine as defined in claim 3, wherein the axial center of the shell main unit resides in the first cylindrical section.

6. The milling machine as defined in claim 1, wherein assuming that the inner diameter of an ore-supply-side portion of the first cylindrical section is taken as S1, the inner diameter of a crushed-stone-outlet-side portion of the first cylindrical section is taken as S2, and a distance between the end of the ore-supply-side portion of the first cylindrical section and the end of the ore-outlet-side portion of the same is taken as T1, (S1–S2)/T1 assumes a value ranging from 0.01 or more to 0.03 or less.

7. The milling machine as defined in claim 1, wherein the cone angle of the second cylindrical section ranges from 30 degrees to 50 degrees.

8. The milling machine as defined in claim 1, wherein the longitudinal center of the shell main unit resides in the first cylindrical section.

9. The milling machine as defined in claim 1, wherein the ratio between the cone angle of the first cylindrical section and the cone angle of the second cylindrical section and the ratio between the axial length of the first cylindrical section and the axial length of the second cylindrical section are set such that the grinding members achieve a substantially uniform distribution within the shell main unit.

10. The milling machine as defined in claim 1, wherein a liner is provided on the internal wall surface of the first and second cylindrical sections in the shell main unit.

11. The milling machine as defined in claim 10, wherein said liner includes a plurality of substantially oval-shaped protuberances.

12. The milling machine as defined in claim 1, further comprising:

grinding members in the shell main unit.

13. The milling machine as defined in claim 1, wherein slits are formed in an outer side of the partition plate to such a size as to hinder passage of the grinding members, and holes are formed in an inner side of the partition plate to such a size as to hinder passage of gravel.

* * * * *